US010442061B2

(12) United States Patent
Hsieh

(10) Patent No.: US 10,442,061 B2
(45) Date of Patent: Oct. 15, 2019

(54) ROTATABLE FASTENING DEVICE AND APPLICATION METHOD THEREOF

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 521 days.

(21) Appl. No.: 15/227,978

(22) Filed: Aug. 4, 2016

(65) Prior Publication Data

US 2017/0297179 A1 Oct. 19, 2017

(30) Foreign Application Priority Data

Apr. 13, 2016 (TW) ..... 105111504 A

(51) Int. Cl.
*B25B 21/02* (2006.01)
*B25B 23/147* (2006.01)
*B25B 13/06* (2006.01)

(52) U.S. Cl.
CPC ..... *B25B 21/02* (2013.01); *B25B 13/06* (2013.01); *B25B 23/1475* (2013.01)

(58) Field of Classification Search
CPC ..... B25B 21/02; B25B 13/06; B25B 23/1475
USPC ..... 173/90
See application file for complete search history.

(56) References Cited

U.S. PATENT DOCUMENTS

2012/0255749 A1 10/2012 Seith et al.

FOREIGN PATENT DOCUMENTS

TW I520817 B 2/2016

*Primary Examiner* — Michelle Lopez
(74) *Attorney, Agent, or Firm* — CKC & Partners Co., LLC

(57) ABSTRACT

A rotatable fastening device disclosed in the present disclosure includes a rotating seat and an impact element. The impact element is one-way pivoted at the rotating seat. The rotating seat is rotated along a rotation axis and detachably connected between a driving tool and an element to be rotated. The weight and kinetic energy of the impact element will provide a one-way tangential impact force around the rotation axis with of rotation.

16 Claims, 10 Drawing Sheets

ROTATABLE FASTENING DEVICE AND APPLICATION METHOD THEREOF

RELATED APPLICATIONS

This application claims priority to Taiwan Application Serial Number 105111504, filed Apr. 13, 2016, which is herein incorporated by reference.

BACKGROUND

Technical Field

The present disclosure relates to a fastening device and an application method thereof. More particularly, the present disclosure relates to a rotatable fastening device and an application method for finally fastening during a rotatable fastening operation and providing an instantly releasing torque.

Description of Related Art

Recently, hand tools are becoming lighter and smaller. Therefore, rotatable fastening tools are also becoming lighter and smaller corresponding to market demands. However, a certainly torque is necessary for finally fastening in a rotatable fastening operation regardless of screws, nuts or other fastening elements. When the fastening is performed by conventional hand tools, such as electrical wrench, cooperated with a sleeve, it is limited by a fixed upper limit of torque provided by a motor of the electrical wrench. Therefore, the conventional electrical wrench cannot satisfy the needs for miniaturization and fastening effect at the same time.

On the other hand, a conventional impact wrench can produce higher torque to have a better fastening effect. However, the conventional impact wrench is performed with an air pump and individually pipelines and usually has a bigger cylinder so that it is hard to be minimized. The impact wrench cannot match the development trends of lightweight and miniaturization due to the problems listed as mentioned above.

A torque control mechanism and a torque control method of a powered tool are now developed in Taiwan patent No. I520817. The mechanism substantially includes a motor, a speed-changing gear set, a transmission shaft, a striking set (such as striking base and output shaft) and a controlling system. The speed-changing gear set is connected to one end of the motor for changing an output rotary power. The transmission shaft is connected with the speed-changing gear set. The output shaft is rotatable coaxially connected to one end of the transmission shaft for connecting with a screwdriver or a sleeve. The striking base is sleeved on the transmission shaft for moving between a striking position and a releasing position along an axis of the transmission shaft. There are striking bumps are correspondingly disposed, respectively, at one end of the output shaft and one end of the striking base. When the striking base moves to the striking position, the striking bumps can be hit with each other to allow the output shaft to rotate and produce a larger instant torque for screwing.

Although the technologies as mentioned in the above patent can increase the fastening torque, the complicate structure and too many elements will allow it being difficult to cooperate with various working pieces. Thus, it still cannot match the market demands of lightweight and miniaturization.

A one-piece sleeve is further developed in U.S. patent application No. 2012/0255749A1 with a gravitational ring. Although the structure is simplified, there is no function for detaching the gravitational element quickly. In addition, the one-piece gravitational ring of the sleeve is hard to be manufactured and will destroy the working piece due to excessive force immediately. The one-piece design will further waste driving energies.

Accordingly, how to integrate the advantages, such as lightweight, miniaturization and fastening, of the rotatable fastening device is an important project to be solved for current developers and manufacturer of the hand tools.

SUMMARY

The present disclosure provides a rotatable fastening device connected between a driving tool and an element to be rotated. The rotatable fastening device includes a rotating seat and an impact element. The rotating seat is rotated along a rotation axis and comprises a driving end and a fastening end. The driving end is detachably connected with the driving tool, and the fastening end is detachably connected with the element to be rotated for driving the element to rotate. The impact element is pivotally configured at an outside of the rotating seat. The impact element is driven by the rotating seat to surround the rotation axis for producing a one-way tangential impact force.

The present disclosure further provides a rotatable fastening device including a rotating seat, at least a one-way position-limiting assembly and an impact element. The rotating seat is rotated along a rotation axis and comprises a fastening end detachably connected with the element to be rotated for driving the element to rotate. The position-limiting groove is disposed at an outside of the rotating seat, and the one-way position-limiting assembly comprises at least one pivotal tooth and an elastic restoring element. The pivotal tooth is pivotally disposed in the position-limiting groove, and the elastic restoring element is disposed in the position-limiting groove for pushing the pivotal tooth outwards. The impact element has a pivoting hole. The pivoting hole is pivoted at the outside of the rotating seat corresponding to the pivotal tooth and has a plurality of one-way position-limiting teeth formed therein. When the rotating seat rotates toward a first rotation direction, the one-way position-limiting teeth cooperate with the pivotal tooth to allow the impact element to be driven. When the rotating seat is stopped for receiving a one-way tangential impact force of the impact element surrounding the rotation axis, the impact element is limited. When the rotating seat rotates toward a second rotation direction, the static impact element is driven. However, the impact element is not driven by the rotating seat due to a stored force of the elastic restoring element when the impact element inertially rotates toward the second rotation direction.

The present disclosure further provides an application method for a rotatable fastening device. The method includes performing a one-way driving step and performing a one-way impacted step. In the one-way driving step, the impact element is driven when the rotating seat rotates toward a fastening direction and is not driven when the rotating seat rotates toward a releasing direction. In the one-way impacted step, the rotating seat limits the impact element when the rotating seat is stopped so as to allow the rotating seat to receive the tangential impact force of the impact element surrounding the rotation axis.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
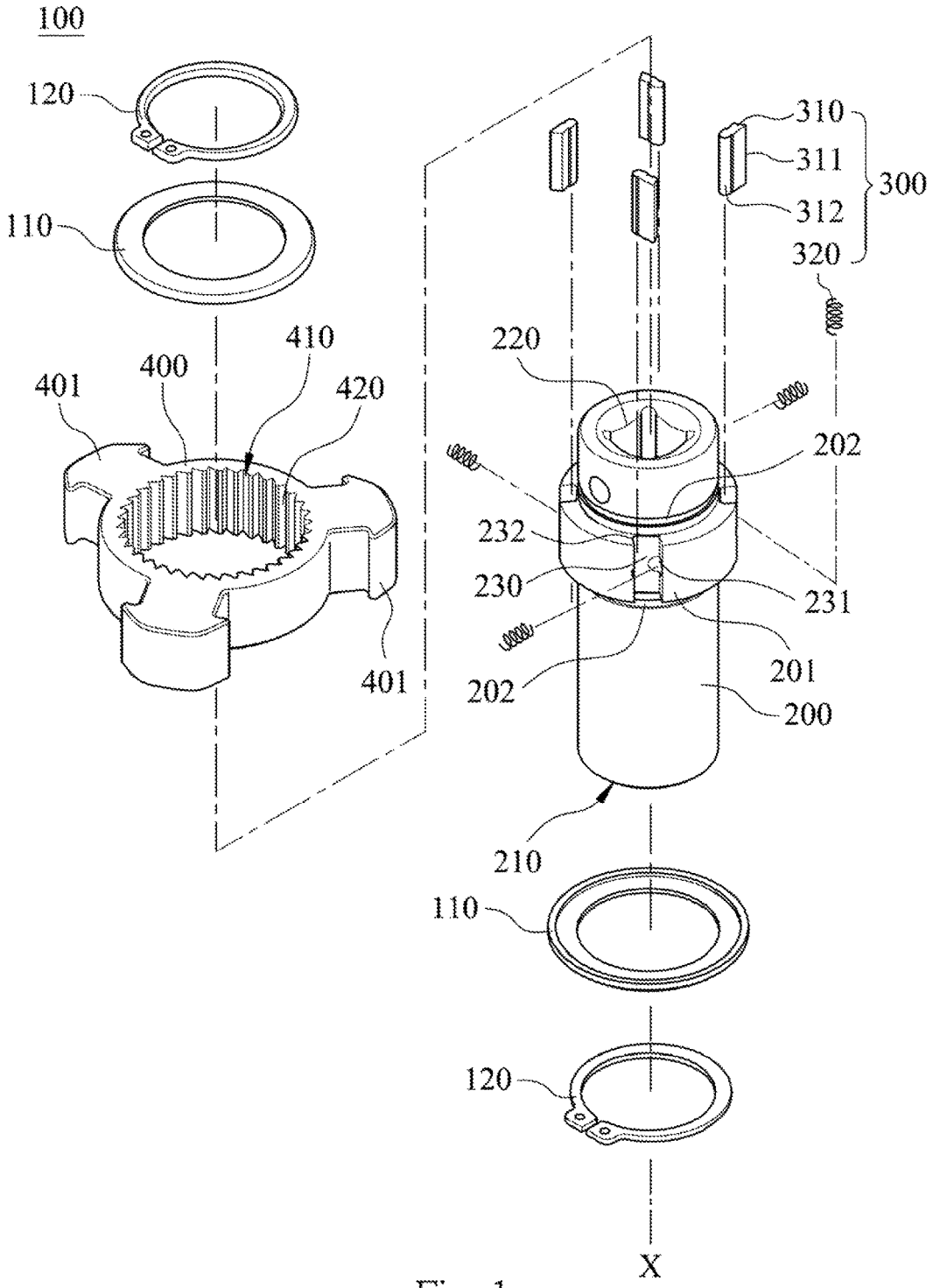
FIG. 1 is an exploded view of a rotatable fastening device according to a first embodiment of the present disclosure.
Figure 2:
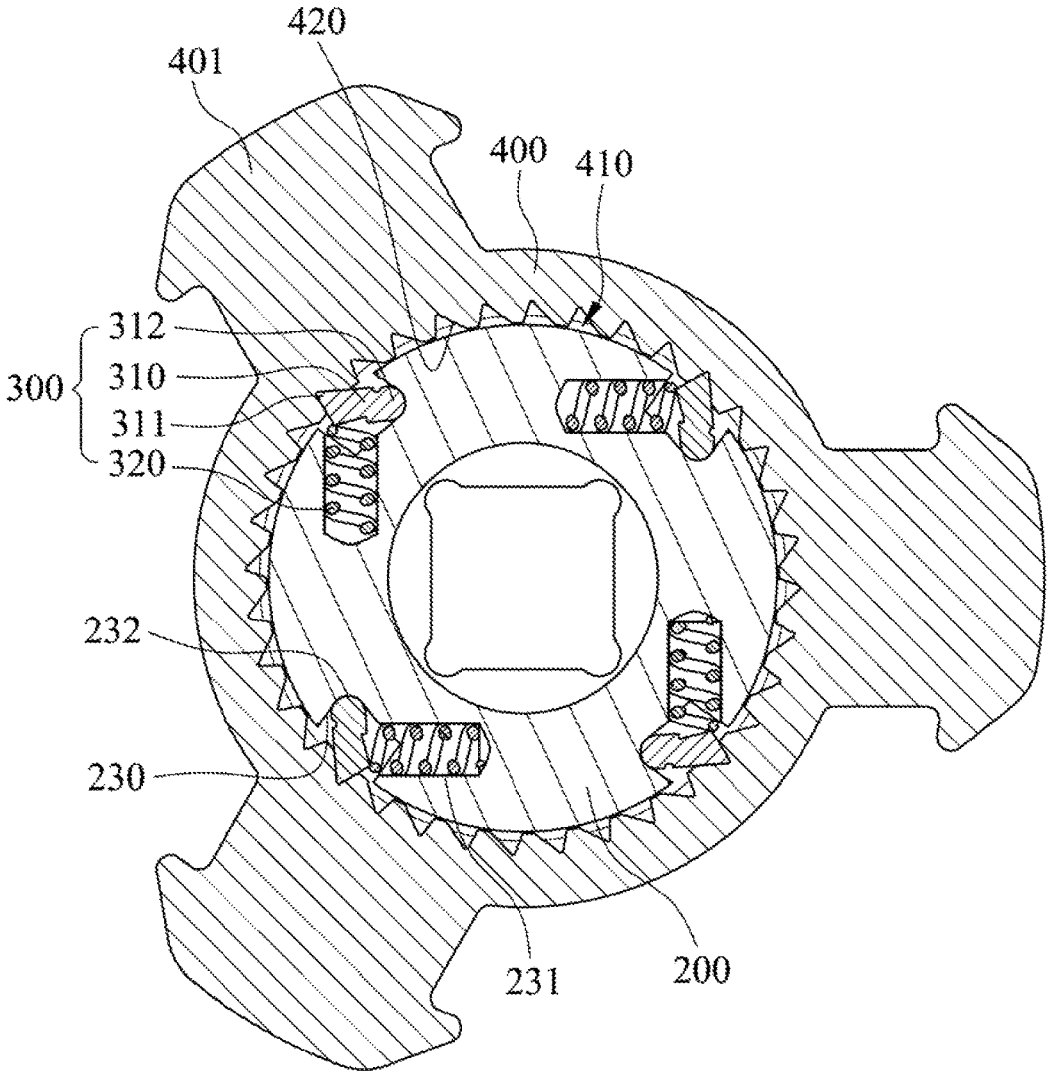
FIG. 2 is a cross-sectional view of the rotatable fastening device according to the first embodiment of the present disclosure.
Figure 3:
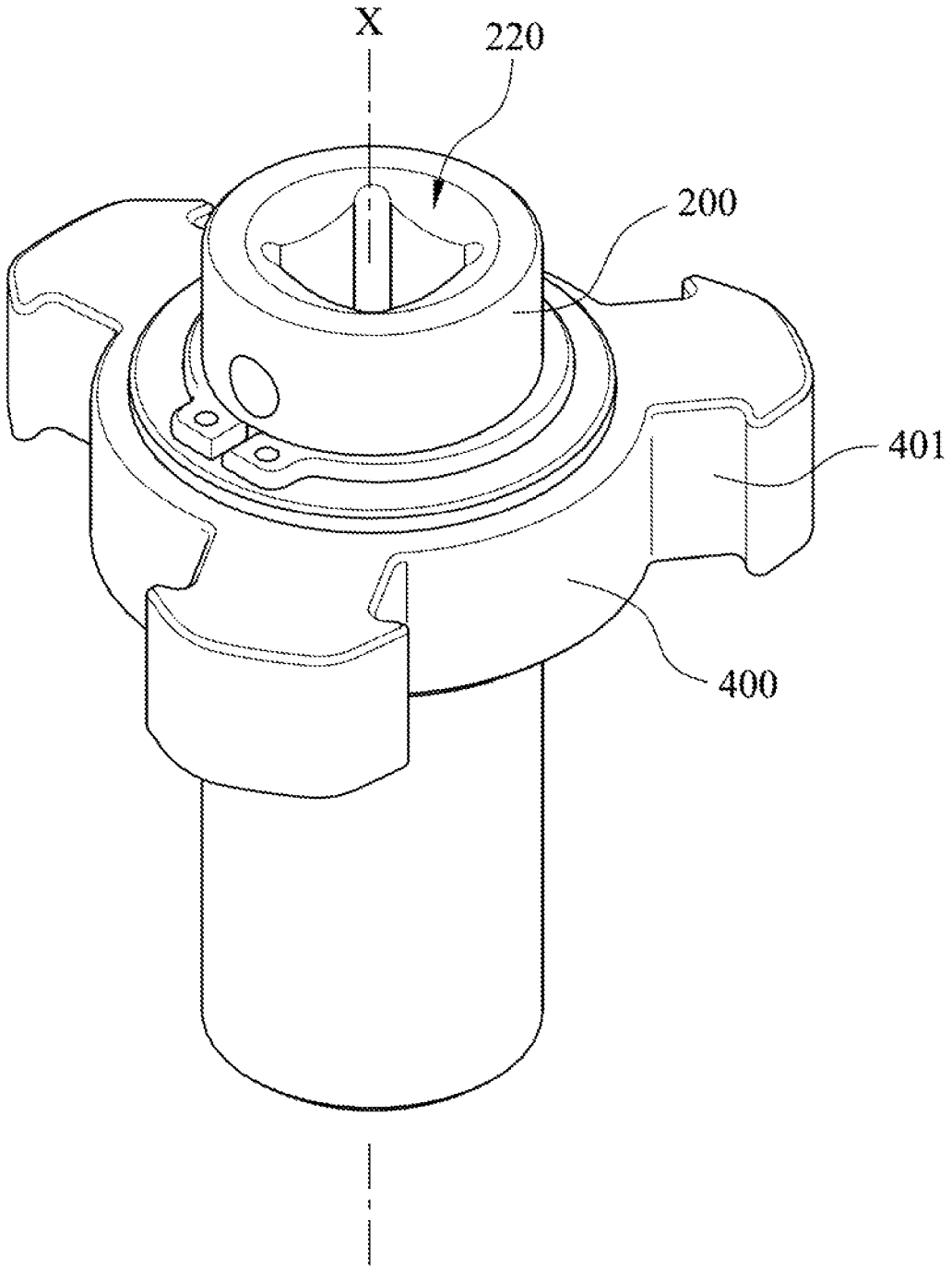
FIG. 3 is a schematic view of the appearance of the rotatable fastening device according to the first embodiment of the present disclosure.
Figure 4:
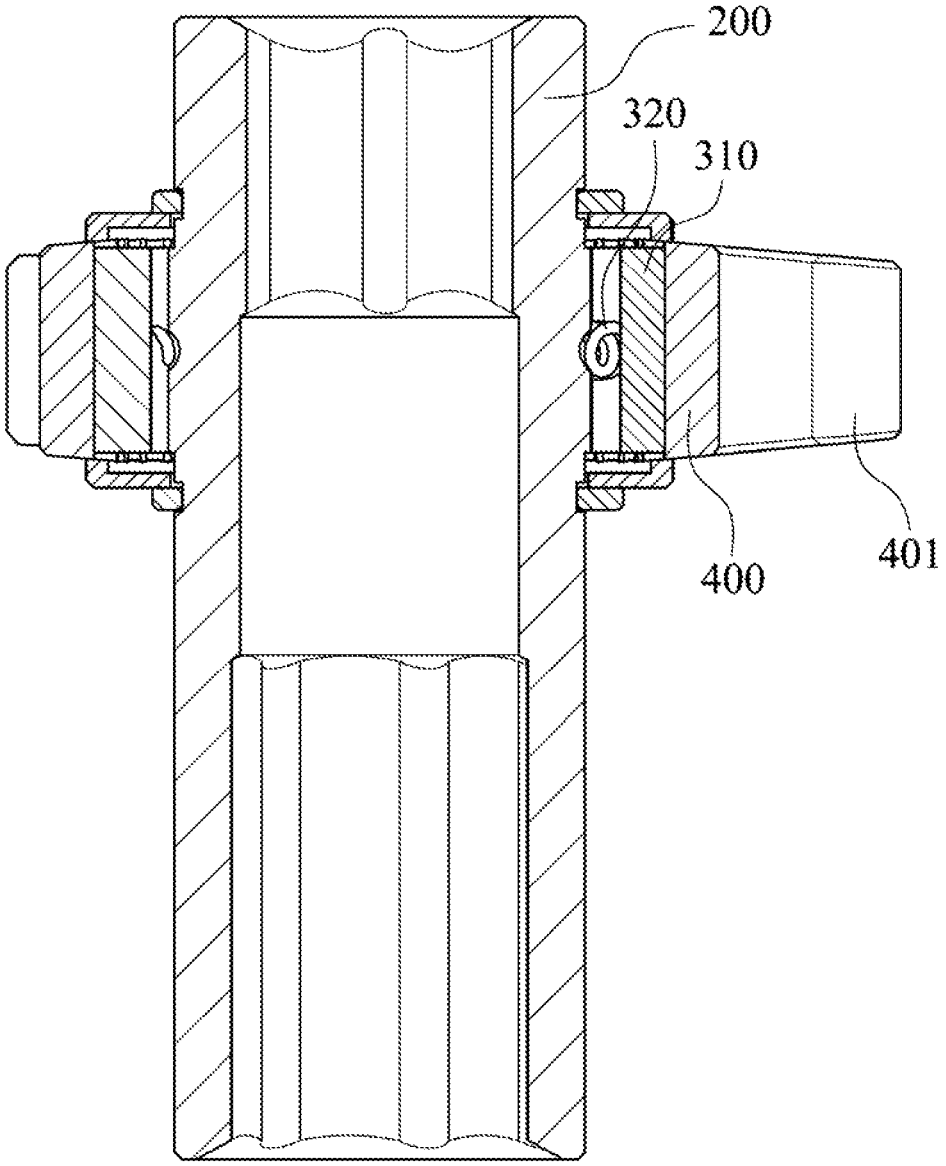
FIG. 4 is a longitudinal section view of the rotatable fastening device according to the first embodiment of the present disclosure.

Please refer to FIGS. 1-4. FIG. 1 is an exploded view of a rotatable fastening device according to a first embodiment of the present disclosure. FIG. 2 is a cross-sectional view of the rotatable fastening device according to the first embodiment of the present disclosure. FIG. 3 is a schematic view of the appearance of the rotatable fastening device according to the first embodiment of the present disclosure. FIG. 4 is a longitudinal section view of the rotatable fastening device according to the first embodiment of the present disclosure. Each detail of structures according to the first embodiment of the present disclosure is illustrated through the figures as mentioned above.

A rotatable fastening device 100 disclosed in the first embodiment of the present disclosure includes a rotating seat 200, four one-way position-limiting assemblies 300 and an impact element 400. In practical, the rotatable fastening device 100 can be a sleeve, and further, the rotatable fastening device 100 can be integrated with a driving tool directly. However, the present disclosure is not limited thereto. The one-way position-limiting assemblies 300 and the impact element 400 are limited by two annular covers 110 and two annular clips 120 in the rotatable fastening device 100.

The rotating seat 200 has a rod-like shape. A fastening end 210 and a driving end 220 are respectively formed at two ends of the rotating seat 200. The fastening end 210 has a hexagon hole to be detachably connected to and drive an element, such as a screw, a nut and a thread rod. The driving end 220 has a square hole with a ball positioning function, and the rotatable fastening device 100 can be driven by an electrical wrench, an impact wrench or a torque wrench through the driving end 220. The rotating seat 200 rotates along a rotation axis X and has a step 201 disposed at its outside. There are four position-limiting grooves 230 equidistantly and surroundingly formed on the step 201. Each of the position-limiting grooves 230 further has a spring groove 231 inwardly formed from its middle. Furthermore, each of the position-limiting grooves 230 is extended parallel to the rotation axis X and has an arc-concave portion 232 therein. The rotating seat 200 further includes two annular grooves 202, and the two annular grooves 202 are disposed at two sides of the step 201 along the rotation axis X.

The one-way position-limiting assembly 300 has four pivotal teeth 310 and four springs 320, which is one of embodiments of the elastic restoring element. Each of the pivotal teeth 310 has a tooth portion 311 on the outer side thereof and an arc portion 312 on the inner side thereof. The arc portion 312 of the pivotal tooth 310 is limited for slidably pivoting in the arc-concave portion 232. Each of the pivotal teeth 310 can be pivoted in each of the position-limiting grooves 230, respectively. Each of the springs 320 can be disposed in the spring groove 231 of each of the position-limiting grooves 230. Each of the springs 320 pushes the pivotal tooth 310 outwards through an opening of the spring groove 231 to allow the tooth portion 311 of each pivotal tooth 310 to have a preload force toward a first rotation direction (as shown in FIG. 7) for pushing the pivotal tooth 310 outwards to have an angle of or about 90 degrees with an axis of the spring 320.

The impact element 400 is an annular body with a pivoting hole 410 at a center thereof. The pivoting hole 410 is sleeved at the outside of the step 201 of the rotating seat 200 and has a plurality of one-way position-limiting teeth 420 entirely and surroundingly disposed therein. The two annular covers 110 cover, respectively, the two sides of the one-way position-limiting teeth 420 along a direction parallel to the rotation direction X. The two annular clips 120 are detachably engaged into the two annular grooves 202 to allow the impact element 400 to be pivotally sleeved at the outside of the rotating seat 200, and four of the one-way position-limiting teeth 420 are engaged with the tooth portions 311 of the four pivotal teeth 310. When the spring 320 pushes the pivotal tooth 310 outwards to have an angle of or about 90 degrees with the axis of the spring 320, the pivotal tooth 310 is cooperated with the one-way position-limiting teeth 420 to rotate along a single direction. Furthermore, there are four arrow-like protrusions 401 integrated on the outside of the impact element 400 for providing a kinetic energy in rotating by their weight.

Figure 5:
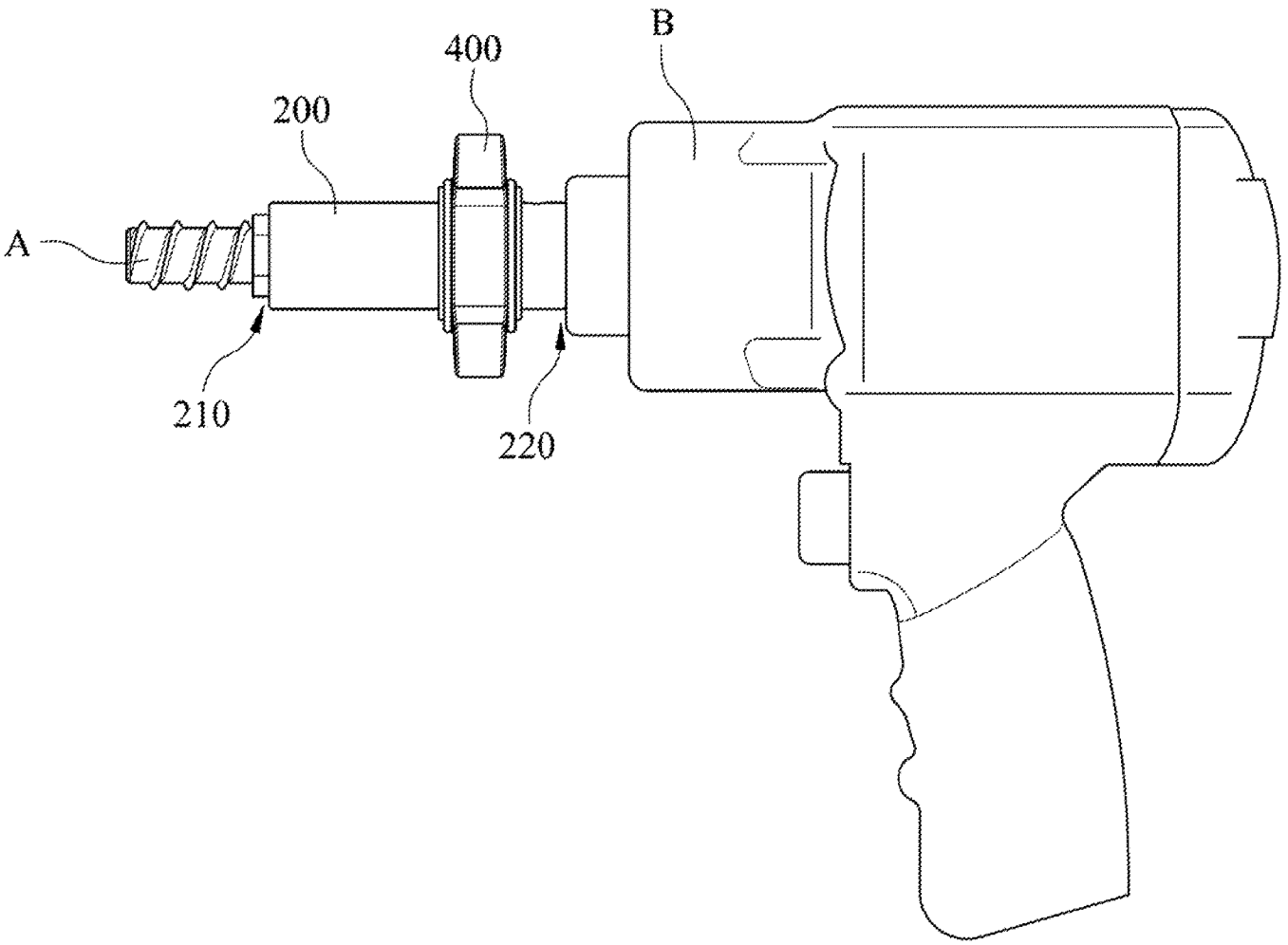
FIG. 5 is an operational schematic view of the rotatable fastening device according to the first embodiment of the present disclosure.
Figure 6:
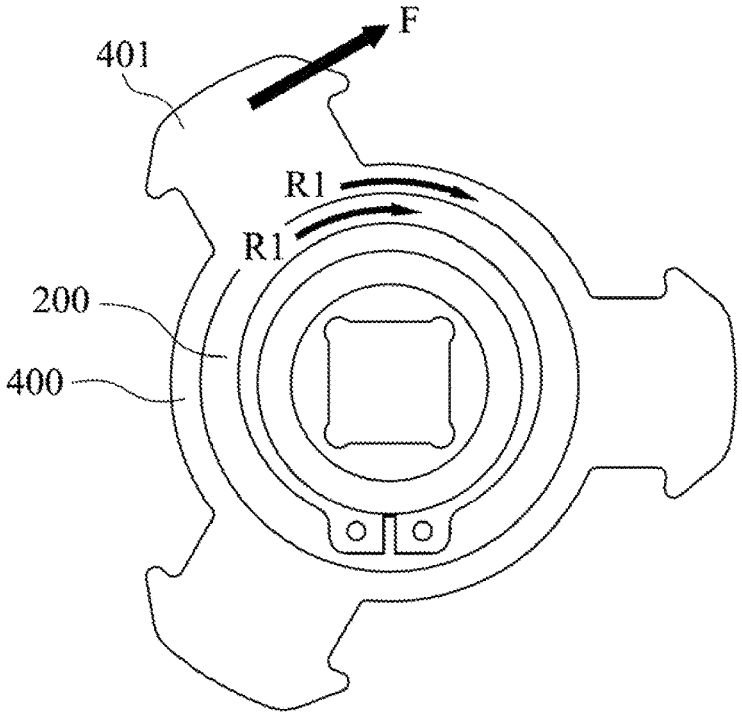
FIG. 6 is a schematic view of the first embodiment before an impact.
Figure 7:
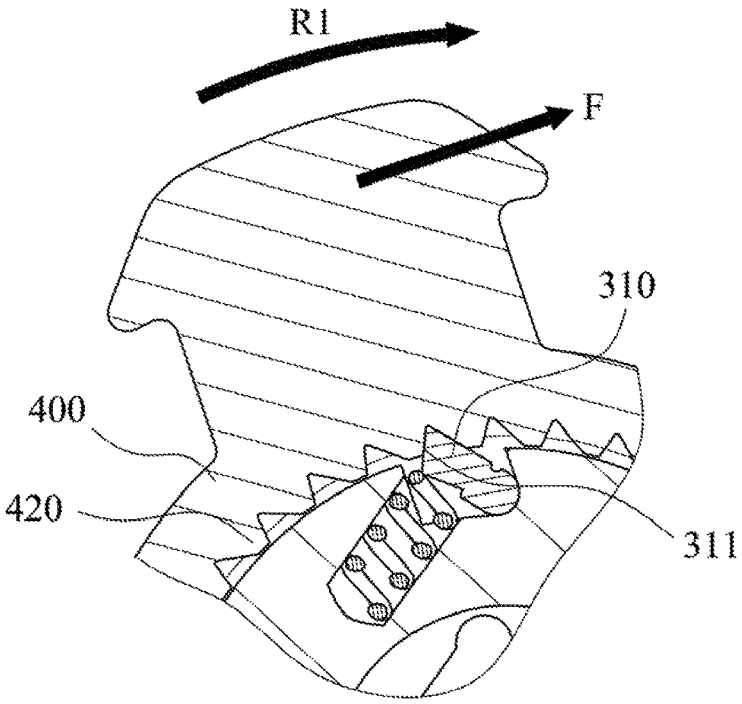
FIG. 7 is a schematic view of the first embodiment during the impact.

Please further refer to FIGS. 5-8. FIG. 5 is an operational schematic view of the rotatable fastening device according to the first embodiment of the present disclosure. FIGS. 6-8 are schematic views of the first embodiment before an impact, during the impact and during the releasing operation, respectively.

In FIG. 5, the fastening end 210 of the rotating seat 200 is connected to and drives a screw A. The driving end 220 is driven by an electrical wrench B at a high speed for fastening the screw A.

When the electrical wrench B drives the rotating seat 200 to rotate toward the first rotation direction R1 (that is, the fastening direction) at the high speed, a contacting torque between the static impact element 400 and the rotating seat 200 is larger in the beginning. The contacting torque will press the pivotal tooth 310 and the spring 320 to store a force and thus the rotating seat 200 will rapidly rotate toward the first rotation direction R1 at first. After the rotating seat 200 drives the screw A continually, the rotating seat 200 utilizes the tooth portions 311 of the four pivotal teeth 310 to outwardly push the impact element 400 to rotate with an equal speed as the rotating seat 200.

In the following, FIG. 6 is provided for describing the condition before the impact in the first embodiment. When the electrical wrench B drives the rotating seat 200 to rotate toward the first rotation direction R1 (that is, the fastening direction) at the high speed, the tooth portions 311 of the pivotal teeth 310 will push the one-way position-limiting teeth 420 to allow the impact element 400 to be rotated with the equal speed as the rotating seat 200. In the meanwhile, the four one-way position-limiting teeth 420 (connected to the impact element 400) are rotated in the first rotation direction R1 rapidly. The four arrow-like protrusions 401, which are disposed at the outside of the impact element 400, rotate toward the first rotation direction R1 rapidly, and therefore, the weight of the four arrow-like protrusions 401 will produce a tangential impact force F surrounding the rotation axis X.

Please refer to FIG. 7. The electrical wrench B reaches a limit of the torque when the rotating seat 200 fastens the screw A so as to be stopped at a moment of fastening. In the meanwhile, each of the one-way position-limiting teeth 420 will be limited by the tooth portions 311 of the four pivoting teeth 310 if it keeps rotating toward the first rotation direction R1. Thus, the tangential impact force F of the impact element 400 will be transmitted to the static rotating seat 200 instantly for improving the fastening effect through the instant impact.

Figure 8A:
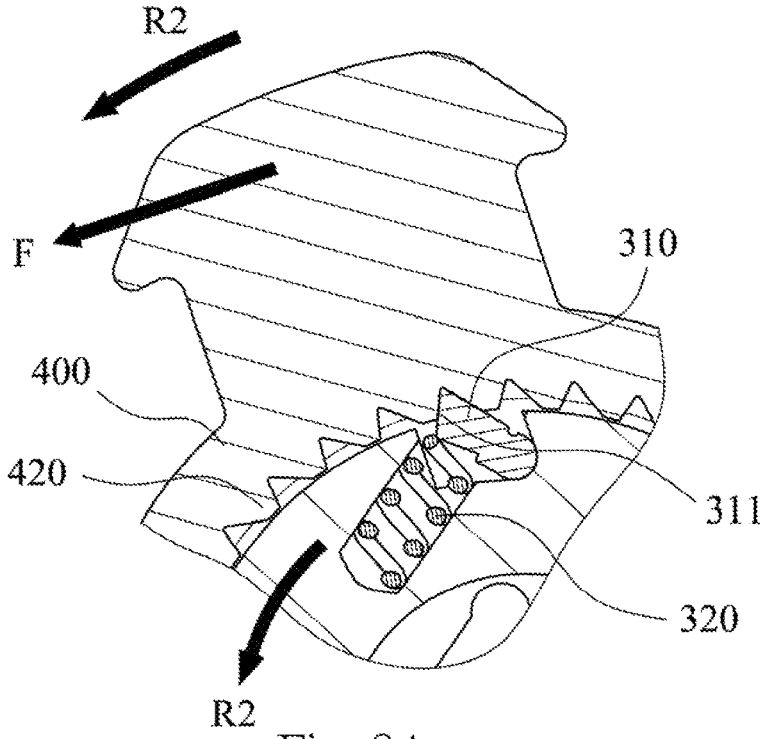
FIG. 8A is a schematic view of an instantaneous driving condition during a releasing operation according to the first embodiment of the present disclosure.
Figure 8B:
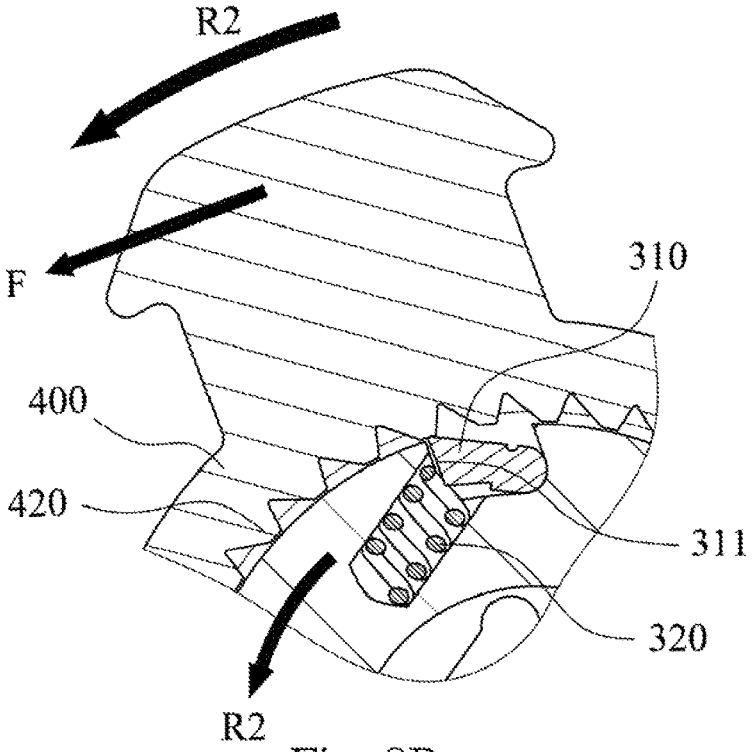
FIG. 8B is a schematic view of allowing the impact element to rotate without the driving during the releasing operation according to the first embodiment of the present disclosure.

Please further refer to FIGS. 8A and 8B. FIG. 8A is a schematic view of an instantaneous driving condition during the releasing operation according to the first embodiment of the present disclosure, and FIG. 8B is a schematic view of allowing the impact element to rotate without the driving during the releasing operation according to the first embodiment of the present disclosure. When the rotating seat 200 rotates toward the second rotation direction R2 for a releasing operation or releasing a rusted and stuck screw, each of the tooth portions 311 of the pivoting teeth 310 contacts with each of the one-way position-limiting teeth 420 along the second rotation direction R2. Because the impact element 400 is static, the rotating seat 200 will limit the one-way position-limiting teeth 420 of the impact element 400 by the pivoting teeth 310 for producing the tangential impact force F (inertial force) so as to allow the impact element 400 to provide a releasing torque instantly through the pivoting teeth 310. After the impact element 400 inertially rotates toward the second rotation direction R2 and is faster than the rotating seat 200, the tangential impact force F of the impact element 400 pushes the pivotal tooth 310 back and presses the spring 320 to store a force so as to allow the impact element 400 to rotate and not to be driven by the rotating seat 200.

Accordingly, the present disclosure can get the releasing torque instantly in the beginning when performing the releasing operation or releasing the rusted and stuck screw. Once the rotating seat 200 overcomes the initial releasing operation and starts rotating toward the second rotation direction R2, the impact element 400 rotates and will not be driven by the rotating seat 200. Thus, the impact element 400 will not influence the releasing operation along the second rotation direction R2 or result in any other inappropriate impacts. That is, the impact element 400 no longer provides the tangential impact force F to result in an inappropriate releasing torque during the following stage of the operation.

Figure 9:
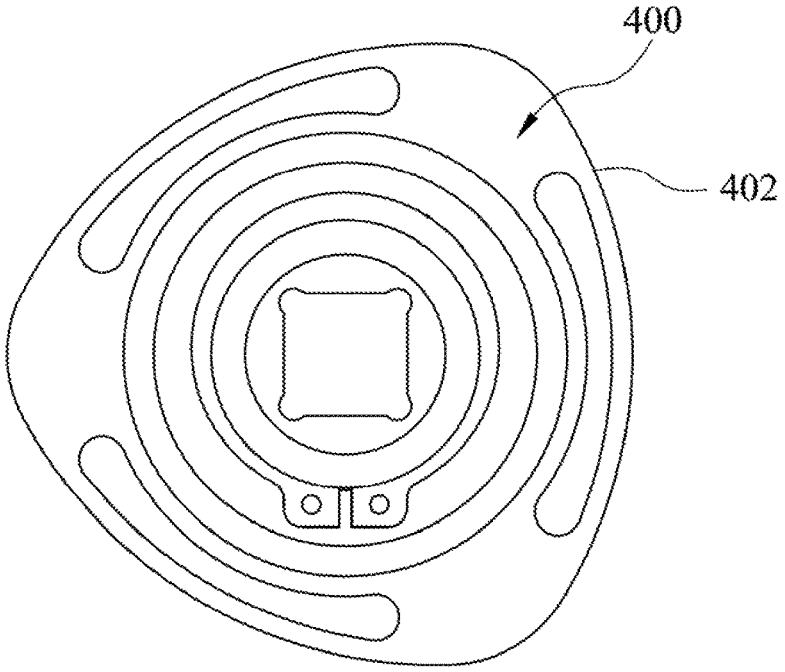
FIG. 9 is a schematic view according to a second embodiment of the present disclosure.
Figure 10:
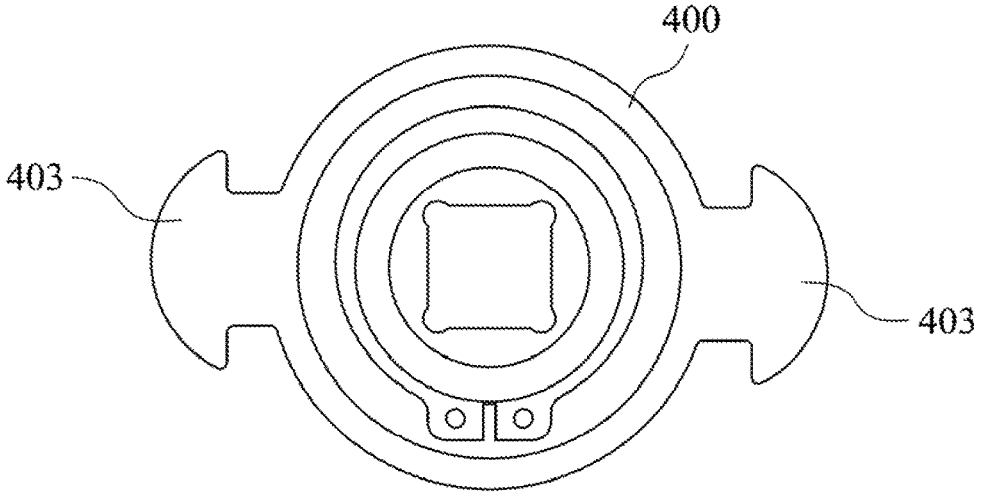
FIG. 10 is a schematic view according to a third embodiment of the present disclosure.

It is noted that FIG. 9 is a schematic view according to a second embodiment of the present disclosure and FIG. 10 is a schematic view according to a third embodiment of the present disclosure. In FIG. 9, it is noted that the impact element 400 can be integrated and a hollow triangular ring 402. The hollow triangular ring 402 shown in the figure also can produce the kinetic energy when rotating for further producing the tangential impact force. In FIG. 10, the impact element 400 has two protrusions 403, which are integrated and opposed to each other. The protrusions 403 shown in the figure also can produce the kinetic energy when rotating for further producing the tangential impact force. In addition, the impact element 400 can be an integrated element with a triangular-like, radial-like or irregular protruded-like appearance. However, various appearances and changes are well-known for the person having ordinary skill in the art so that there is no further description herein.

Figure 11:
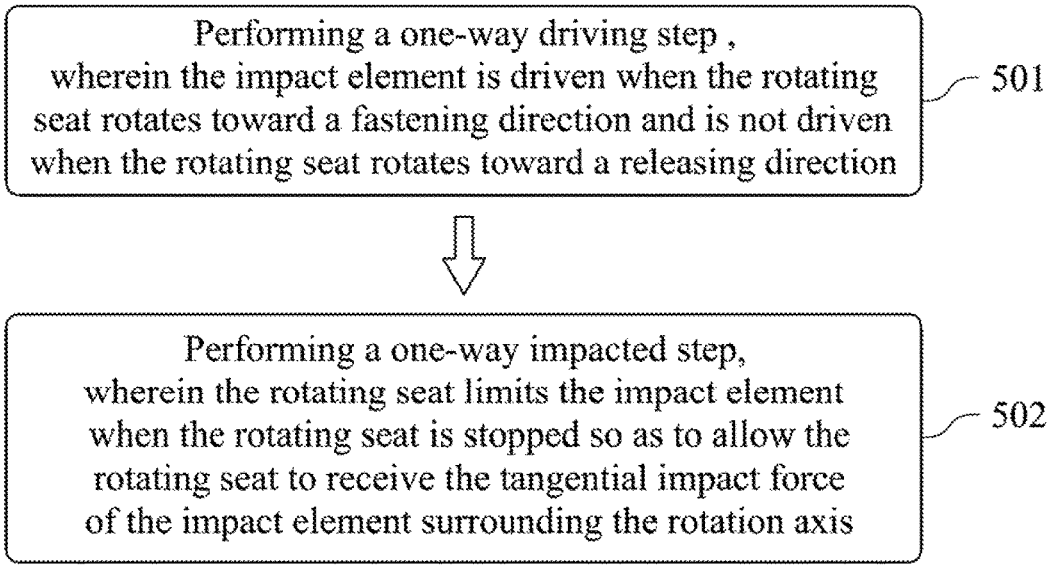
FIG. 11 is a flow chart showing an application method for the rotatable fastening device of the present disclosure.

Please refer to FIG. 11, which is a flow chart showing an application method for the rotatable fastening device of the present disclosure. The application method is applied to each of the embodiments of the abovementioned rotatable fastening device. The application method includes a one-way driving step 501 and a one way impacted step 502. An appropriate fastening impact force can be improved by the application method of the present disclosure under a smaller occupation.

In the one-way driving step 501, the impact element is driven when the rotating seat rotates toward the fastening direction and is not driven when the rotating seat rotates toward the releasing direction. And then, in the one-way impacted step 502, the rotating seat limits the impact element when the rotating seat is stopped so as to allow the rotating seat to receive the tangential impact force of the impact element surrounding the rotation axis.

It is noted that the rotating seat can provide the tangential impact force instantly when the rotating seat is stopped in the one-way impacted step. However, the impact element also can rotate for an instantaneous distance to be limited. That is, both the methods as mentioned above can achieve the same effect although they have a time difference.

Figure 12:
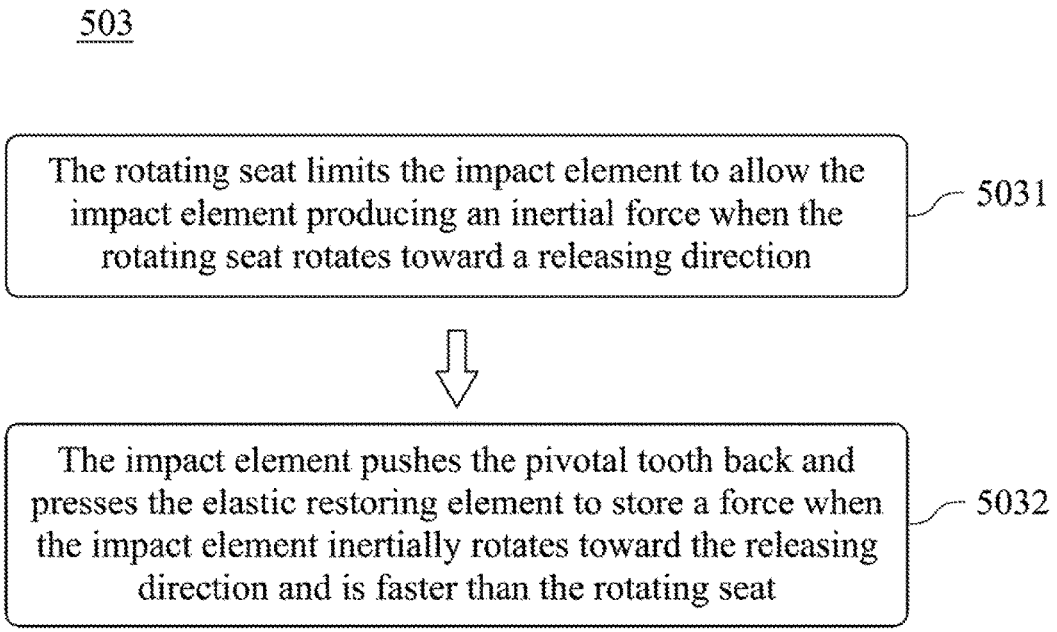
FIG. 12 is a flow chart showing another application method for the rotatable fastening device of the present disclosure.

Please refer to FIG. 12, which is a flow chart showing another application method for the rotatable fastening device of the present disclosure. Finally, another application method for the rotatable fastening device with the elastic restoring element includes performing a releasing step 503. When the rotating seat rotates toward the releasing direction (the second rotation direction), the rotating seat limits the impact element to allow the impact element producing the inertial force so as to provide the releasing torque instantly in a first stage 5031 of the releasing step 503. When the impact element inertially rotates toward the releasing direction and is faster than the rotating seat, the impact element pushes the pivotal tooth back and presses the elastic restoring element to store a force so as to allow the impact element not to be driven by the rotating seat in a second stage 5032 of the releasing step 503.

In addition, the one-way assembly can further include a locking device corresponding to the pivoting tooth for keeping the pivotal tooth at an open position and a dose position. Accordingly, the operation of the present disclosure can be an entirely limited condition or an entirely free pivoting condition. The locking device can be a conventional tool, such as a hasp or a magnetic tool, for locking the pivoting tooth.

The following advantages can be achieved by the rotatable fastening device and the application method thereof in the present disclosure.

First, the one-way tangential impact force can be provided for improving the fastening effect by using less and minimized elements. That is, the requests for lightweight, miniaturization and changeable can be achieved without the waste of resources.

Second, the impact element can be free or produce an instantaneous releasing torque when the rotating seat rotates toward the second rotation direction. Thus, the rotating seat will not keep driving the impact element so that the impact element will not influence the following releasing operation or result in an inappropriate and excessive impact.

Third, the impact element is static when the rotating seat starts to rotate toward the first rotation direction. However, the initial action will not be effected by the static impact element. The rotating seat will push the impact element gradually and continuously to rotate with the equal speed for preventing the the initial speed of the fastening operation from being influenced.

Fourth, the appearance of the impact element can be varied depended on the required quantity of the tangential impact force. That is, the present disclosure can match different needs of applications.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A rotatable fastening device, connected between a driving tool and an element to be rotated, comprising:

a rotating seat rotated along a rotation axis and comprising:

a driving end detachably connected with the driving tool; and a fastening end detachably connected with the element to be rotated for driving the element to rotate;

an impact element pivotally configured at an outside of the rotating seat, wherein the impact element is driven by the rotating seat to surround the rotation axis for producing a one-way tangential impact force; and a one-way position-limiting assembly disposed on the rotating seat and selectively engaged with the impact element;

wherein when the rotating seat rotates toward a first rotation direction, the one-way position-limiting assembly provides an elastic restoring force to rotate the impact element so as to allow the rotating seat to receive the one-way tangential impact force of the impact element surrounding the rotation axis;

wherein when the rotating seat rotates toward a second rotation direction, the impact element is not driven by the one-way position-limiting assembly.

2. The rotatable fastening device of claim 1, wherein the one-way position-limiting assembly is a one-way bearing.

3. The rotatable fastening device of claim 1, wherein the impact element is an annular-like element, a triangular-like element, a radial-like element, a rod-like element or a block-like element.

4. The rotatable fastening device of claim 1, wherein the rotatable fastening device is a sleeve.

5. A rotatable fastening device, comprising:

a rotating seat rotated along a rotation axis, wherein the rotating seat comprises:

a fastening end detachably connected with the element to be rotated for driving the element to rotate; and at least one position-limiting groove disposed at an outside of the rotating seat;

a one-way position-limiting assembly comprising:

at least one pivotal tooth pivotally disposed in the position-limiting groove; and an elastic restoring element disposed in the position-limiting groove for pushing the pivotal tooth outwards; and an impact element having a pivoting hole, wherein the pivoting hole is pivoted at the outside of the rotating seat corresponding to the pivotal tooth and has a plurality of one-way position-limiting teeth formed therein;

wherein the one-way position-limiting teeth cooperates with the pivotal tooth to allow the impact element to be driven through a stored force of the elastic restoring element when the rotating seat rotates toward a first rotation direction and to be limited when the rotating seat is stopped for receiving a one-way tangential impact force of the impact element surrounding the rotation axis;

wherein the impact element is not driven by the rotating seat when the impact element inertially rotates toward a second rotation direction.

6. The rotatable fastening device of claim 5, wherein the impact element is an annular-like element, a triangular-like element, a radial-like element, a rod-like element or a block-like element.

7. The rotatable fastening device of claim 5, wherein the elastic restoring element is a spring, an elastically adhesive lump or a combination of a spring and a ball.

8. The rotatable fastening device of claim 5, wherein, a quantity of the position-limiting groove is four, which are equally surrounded at the outside of the rotating seat;

a quantity of the one-way position-limiting assembly is four, and the four one-way position-limiting assemblies are correspondingly disposed in the four position-limiting grooves; and the plurality of one-way position-limiting teeth are entirely and surroundingly disposed in the pivoting hole of the impact element.

9. The rotatable fastening device of claim 5, wherein the pivotal tooth is cooperated with the one-way position-limiting teeth to rotate along a single direction when the elastic restoring element pushes the pivotal tooth outwards to have an angle of 90 degrees with each other.

10. The rotatable fastening device of claim 9, wherein the position-limiting groove has an arc-concave portion and the pivotal tooth has an arc end portion for slidably pivoting in the arc-concave portion.

11. The rotatable fastening device of claim 5, wherein the rotatable fastening device is a sleeve.

12. The rotatable fastening device of claim 5, wherein the one-way position-limiting assembly comprises a locking device for keeping the pivotal tooth at an open position and a close position.

13. An application method for the rotatable fastening device of claim 5, comprising:

performing a one-way driving step, wherein the impact element is driven when the rotating seat rotates toward a first direction and is not driven when the rotating seat rotates toward a second direction; and performing a one-way impacted step, wherein when the rotating seat rotates toward the first rotation direction, the elastic restoring element is compressed and then the elastic restoring element releases an elastic restoring force to push the pivotal tooth to rotate the impact element for providing a one-way tangential impact force to the rotating seat by the impact element surrounding the rotation axis;

wherein when the rotating seat rotates toward the second rotation direction, the impact element is not driven by the rotating seat.

14. The application method for the rotatable fastening device of claim 13, wherein, the rotating seat allows the impact element to further rotate for a distance and to be limited in the one-way impacted step.

15. An application method for the rotatable fastening device of claim 1, comprising:

performing a one-way driving step, wherein the impact element is driven when the rotating seat rotates toward a first direction and is not driven when the rotating seat rotates toward a second direction; and performing a one-way impacted step, wherein the one-way position-limiting assembly provides an elastic restoring force to rotate the impact element so as to allow the rotating seat to receive the one-way tangential impact force of the impact element surrounding the rotation axis;

wherein when the rotating seat rotates toward the second rotation direction, the impact element is not driven by the rotating seat.

16. The application method for the rotatable fastening device of claim 15, wherein, the rotating seat allows the impact element to further rotate for a distance and to be limited in the one-way impacted step.

* * * * *